United States Patent [19]

Hancock

[11] 4,006,727

[45] Feb. 8, 1977

[54] ANGLE DRESSING TOOL

[76] Inventor: Seth E. Hancock, 3502 Carla Drive, Austin, Tex. 78754

[22] Filed: Dec. 3, 1975

[21] Appl. No.: 637,288

[52] U.S. Cl. ..... 125/11 AT; 125/11 B

[51] Int. Cl.[2] ..... B24B 53/04

[58] Field of Search ..... 125/11 R, 11 B, 11 AT

[56] References Cited

UNITED STATES PATENTS

| | | | |
|---|---|---|---|
| 1,596,701 | 8/1926 | Williams | 125/11 B |
| 1,790,651 | 2/1931 | Berg | 125/11 B |
| 2,402,945 | 7/1946 | Brocker | 125/11 B |
| 2,479,101 | 8/1949 | Dahl | 125/11 AT |
| 3,006,331 | 10/1961 | Akert | 125/11 AT |
| 3,187,737 | 6/1965 | Oscar | 125/11 R |
| 3,576,184 | 4/1971 | Nichols | 125/11 B |

*Primary Examiner*—Harold D. Whitehead
*Attorney, Agent, or Firm*—J. Harold Kilcoyne

[57] ABSTRACT

An angle-dressing tool for dressing angular surfaces on rotating grinding wheels and the like characterized by a dovetail way member and means for setting same in a selected one of a plurality of angular positions about a horizontal axis, leadscrew and nut means operative in a hollowed-out longitudinal recess provided in the way portion of said dovetail way member, said nut being actuable linearly in opposite directions with rotation of the leadscrew, a dovetail slide member having ways complemental to the ways of the way member and being affixed to said nut for linear motion therewith and being further movable to angular positions in accordance with the angular setting of the dovetail way member, a block affixed directly to the dovetail slide member and partaking of linear and angular motion therewith, and an uprightly extending diamond-tipped shaftform member mounted in said block for movement therewith.

4 Claims, 4 Drawing Figures

ANGLE DRESSING TOOL

THE INVENTION - IN GENERAL

This invention relates to improvements in grinding wheel dressing tools of the type adapted to support a diamond-tipped member in generaly upright position and so that it may be bodily translated linearly, as well as angularly about an axis and to either side of said axis.

BACKGROUND OF THE INVENTION

While grinding wheel dressing tools of the above generally stated type are known in the art -- examples being the dressing tools disclosed in U.S. Pats. to Oscar Nos. 3,187,737 dated June 8, 1965 and to Rohrle 3,685,505 dated Aug. 22, 1972, such have not been accorded any great degree of popularity or usage, due to the fact that the many and varied operations which the dressing tools of said patents are designed to provide render them so expensive to construct and so complicated in their operation as to bring them beyond the reach and need of the tool-shop owner requiring an angle dresser for his grinding wheel operations of simple, inexpensive construction, while at the same time possessing the capability of being quickly set up when needed and which provides the additional advantage of being consistently accurate and safe in operation.

OBJECTS OF THE INVENTION

Briefly stated, the invention has for its primary object that of providing the art, and in particular the small tool shop owner, with an angle dresser for grinding wheels characterized by simple design enabling its relatively inexpensive construction, while at the same time having the capability of being readily and quickly set up for operation when angle dressing of a grinding wheel is needed and which is consistently accurate and safe in its operation.

Other objects and advantages of an angle dresser for grinding wheels according to my invention will become apparent from the following detailed description of an illustrative embodiment thereof shown in the appended drawing figures, wherein.

Figure 3:
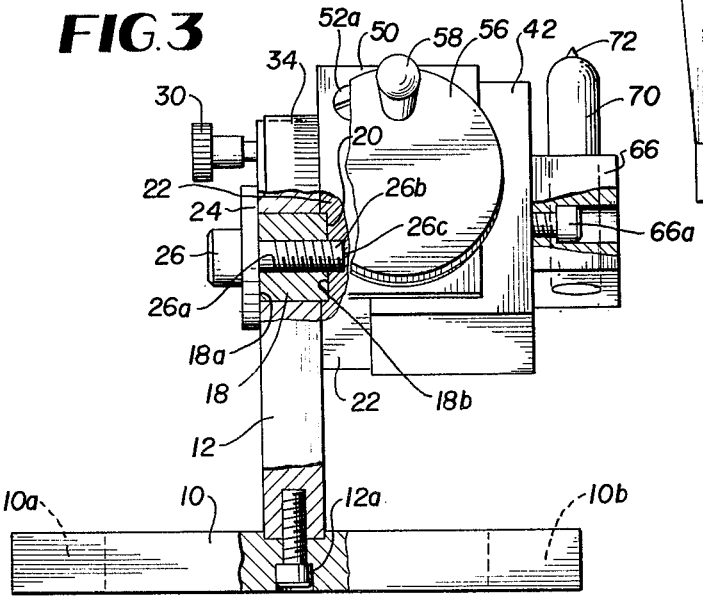
Figure 4:
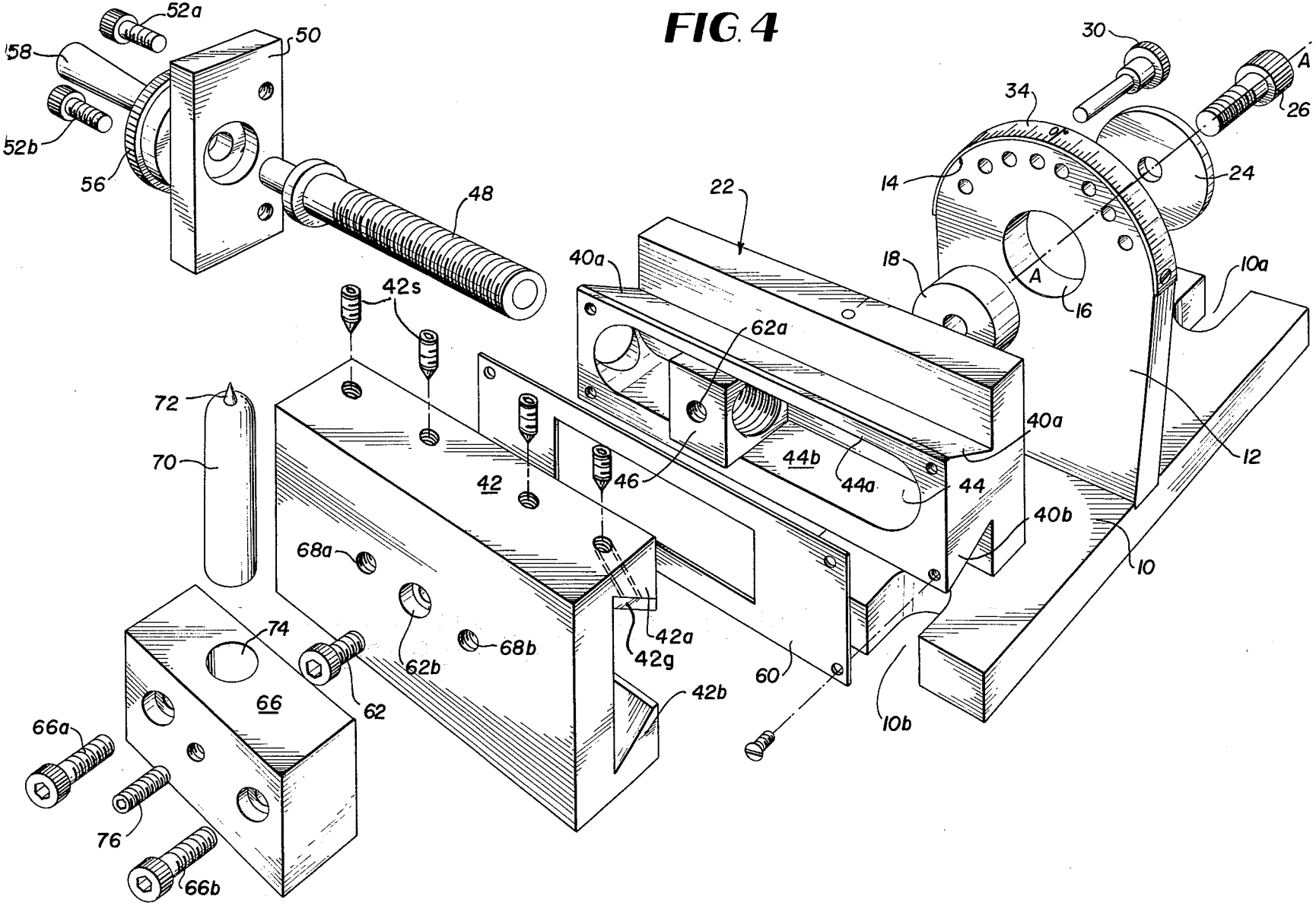

FIG. 3 is a side elevation of my angle dresser, with parts broken away to illustrate in section both a preferred means for securing the dovetail way member thereof in a desired angular position about the horizontal tool axis and a simplified form of mounting a diamond-tipped shaft-form member to the linearly translatable dovetail slide member; and FIG. 4 is an exploded view illustrating the individual structural parts making up my improved and simplified angle dressing tool prior to their assembly one to the other as a workable tool.

DETAILED DESCRIPTION OF THE DRAWING FIGURES

Referring to the drawing figures in detail, reference numeral 10 designates a rectangular base plate shown to be provided in its front and rear edges with blind-ended clamp-bolt receiving slots 10a, 10b for the reception of clamp bolts (not shown) by which said base plate and parts carried thereby can be quickly set up and secured for a grinding-wheel angle dressing operation as needed.

As best seen in FIG. 3, said base plate 10 mounts a transversely extending upright 12 which is fixedly secured to the base plate as by one or more screws 12a. For a purpose to be hereinafter explained, the upper edge 14 of said upright 12 extends along a semi-circular arc of relatively large radius, i.e. one half the width of said upright, struck from the center of a circular opening 16 through the upright, which center is disposed on the horizontal tool axis A—A (FIG. 4), the diameter of said circular opening 16 being such as to snugly receive a preferably brass bushing 18 whose axial length exceeds the thickness of the upright 12 by a small amount. Thus, again referring to FIG. 3, when the front end face **18*a* of said bushing is disposed flush with, i.e. in the plane of, the front face of the upright 12, the other end 18*b* of the bushing will project a small distance beyond the upright's rear face into a small-depth circular recess 20 provided therefor in the front planar face of a dovetail way member 22 which is angularly turnable on the bushing end 18b,** as will be later described in greater detail.

According to the invention, the bushing 18 is normally secured in axial position such that its front-end face **18*a* is flush with the front planar face of the upright 12 by a clamp washer 24 having substantially greater outer-edge diameter than that of said bushing and which is normally held tight against said planar front face of the upright by the under-head surface of a headed clamp bolt 26, whose threaded shank 26*a* extends through bushing opening which is provided with mating threads and terminates in a threaded end 26*b* which extends into a threaded opening 26*c* provided therefor and which is countersunk in the front planar face of the dovetail member 22 centrally of the aforesaid recess 20 in which the rearward projecting end of the bushing 18** extends, as above described.

By the aforesaid arrangement of parts, the dovetail way member 22 may be positively secured in a selected angular position simply by tightening the clamp bolt 26, and said selected angular position may be varied by a slight loosening or backing-off of said clamp bolt, thereupon manually adjusting the angular position of the dovetail way member to that desired by turning it about the bushing end **18*b* serving as a hub, followed by re-tightening of said clamp bolt 26.**

Figure 1:
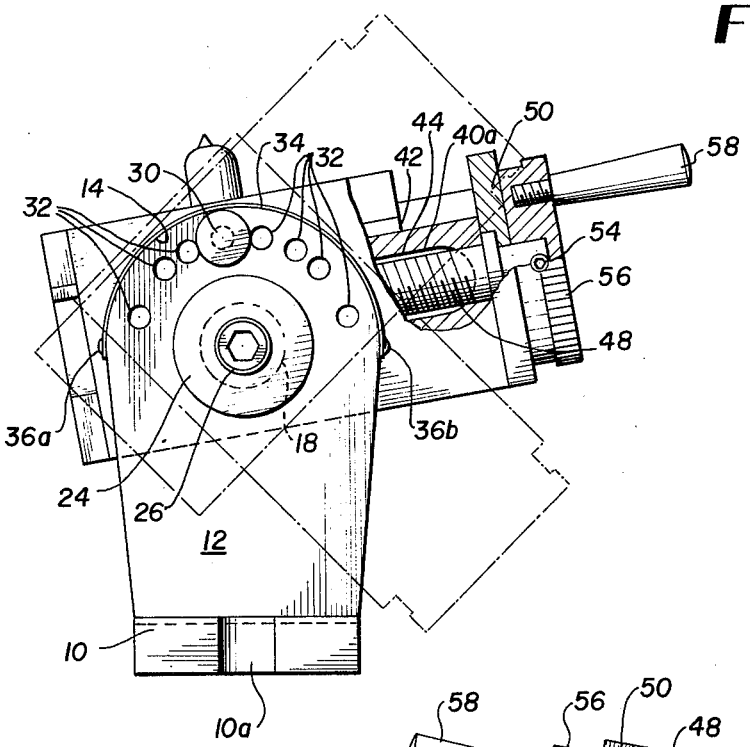
FIG. 1 is a front elevation of an angle dresser for grinding wheels as herein proposed, with parts thereof broken away to illustrate in section a short-length portion of the leadscrew, rotation of which by a hand wheel effects bodily translation of a diamond-tipped shaft-form member.

According to the invention, the dovetail way member 22 may be set as aforesaid in one of the extreme angular positions shown in dot-dash lines in FIG. 1, or it may be angled and secured in one of a plurality of intermediate or so-called angular positions therebetween, as determined by manual insertion of an index pin 30 in a selected one of a series of index pin-receiving holes provided therefor through the upright 12, the shank end of the index pin having length such that it will extend into one of a corresponding series of pin-receiving holes (not shown) provided therefor in the front planar face of the dovetail way member.

Illustratively, a series of four index holes 32 are provided in the upright to each side of the 0° marking on a vernier scale 34 secured at its ends as by small-screws **36*a*, 36*b* to the prior-referred-to semi-circular top or upper edge 14 of the upright 12.** Preferably, said four index pin-receiving holes to each side of the aforesaid 0° marking are spaced at angles of 10°, 30°, 45° and 75° from the 0 marking, thus providing four standard angular settings of the dovetail way member to either side of the 0° marking.

Should non-standard angular settings of the dovetail way member be called for, the index pin 30 is deactivated completely, i.e. withdrawn from any one index hole 32 in which it was previously inserted, whereupon the same procedural steps of loosening the clamp bolt 26, adjusting the angular position of the dovetail way member to the non-standard setting desired, and finally re-tightening the clamp bolts 26, are followed, such frictionally holding the dovetail way member against the rear face of the upright 12 in the non-standard angular position to which it was manually angled as aforesaid.

As best seen in FIG. 4, the dovetail way member 28 is provided wit way formations 40*a*, 40*b* (hereinafter termed "ways") providing a slideway for a movable dovetail slide member generally designated 42 which is provided with complemental way formations 42*a*, 42*b*, of which the upper way formation 42*b* mounts a gib 42g of a suitable wear metal which is adapted to be pressed downwardly at spaced points along its length as by four spaced-apart set screws 42*s* operating in threaded holes extending downwardly through said upper way formation to said gib and which by exerting downward pressure on the gib, insures take-up of such wear on the way formation 42*b* as might develop during extended operation of the dresser. Preferably, the portion of the dovetail way member intermediate its aforesaid ways 40*a*, 40*b* is hollowed out so as to provide an open front, longitudinal recess designated 44 having spaced planar top and bottom machined surfaces 44*a*, 44*b* along the length of which a leadscrew-nut 46 is adapted to be actuated in one or the opposite direction upon rotation being imparted to a leadscrew 48 which is threaded through the aforesaid leadscrew nut 46.

Referring to FIGS. 1 and 4, one (the operating) end of the leadscrew 48 extends outwardly through the corresponding end of the aforesaid longitudinal way recess 44 and is journaled for rotation in a thrust plate 50 secured flush against the planar end face of the dovetail way member, as by headed machine screws 52a, 52b, the thrust plate 50 thus closing off one end of the recess 44 along the length of which the leadscrew nut is translatable responsive to leadscrew rotation.

Said leadscrew end projects a small distance beyond the thrust plate 50 and said end is secured as by a pin 54 in a leadscrew turning hand wheel 56 provided with a projecting crank or handle 58. Although not shown, the other end of the leadscrew 48 may be suitably journaled as by socketing it in the opposite preferably closed end of the way recess 44.

Figure 2:
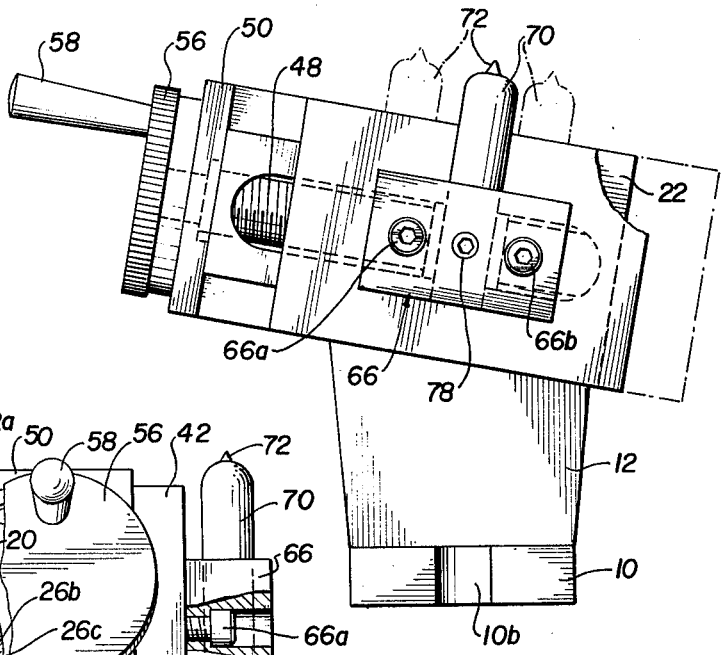
FIG. 2 is a rear, i.e. working-end, elevation, of my improved angle dresser for grinding wheels as herein proposed.

Illustratively, the open front of said leadscrew and nut recess 44 may be closed as by a thin rectangular (preferably sheet-metal) dust cover 60 secured at its corners (as by small screws not shown) to the planar faces of the spaced ways 40a, 40b, said dust cover however being provided with an elongated window 60a through which a portion of the leadscrew-actuable nut 46 projects during the course of its linear movement. Said dust cover is however not shown in FIG. 2.

The above-referred to dovetail slide member 42 is affixed to the leadscrew nut 46 for linear movement therewith, illustratively by a machine screw 62 passed through a hole in the rear planar face of the slide member and whose threaded shank extends into a threaded hole 62a provided in the nut member. Preferably, the head of said machine screw 62 seats fully in a head recess provided therefor in said rear planar face of the slide member.

Secured flush against said planar outer face of the dovetail slide member 42 as by machine screws 66*a*, 66*b* is a rectangular block 66, the screws 66a, 66b as seen in FIG. 4 having length such that they thread fully through said block 66 and thence by a small amount into threaded holes 68a, 66b disposed symmetrically to the sides of the aforesaid recess 62a which receives the slide member-to-nut machine screw 62.

The aforesaid block 66 fixedly mounts in generally upright position a shaft-form member 70 tipped at its upper end with an industrial diamond 72 constituting a grinding wheel dressing element per se. To operatively yet removably mount said member 70 to the block 66 as aforesaid, the block is provided with a vertically disposed hole 74 whose diameter is only slightly greater than that of said diamond-tipped shaft-form member 70 so that the latter while readily insertible therein has but slight clearance in said hole. When so inserted, the lower end of the shaft-form member 70 may be secured fast therein by a set screw 76 threaded into the block to the depth of said hole 74.

It will be appreciated that by the aforesaid arrangement of parts, said block 66 and diamond-tipped shaft-form member 70 will partake of such linear motion in either direction as is imparted to the dovetail slide member 42 responsive to rotation of the leadscrew 48, and similarly that said dovetail slide member 42, block 66 and diamond-tipped shaft-form member 70, acting in unison, will partake of such angular movement of the dovetail way member 22 as is imparted to the latter in the course of its being set in a selected angular position.

Considering that the intended function of the herein-disclosed angle dresser is to dress angular surfaces on rotating grinding wheels used for surface grinding, on tool and cutter grinders, etc., such function is simply and effectively fulfilled by manual rotation of the leadscrew 48 by the hand wheel 56 in either clockwise or counterclockwise direction (clockwise to move the dovetail slide member and diamond away from the operator and counterclockwise to move said slide member and diamond toward the operator). The degree of angle is readily controlled by the operator's setting of the dovetail way member 22 in any one of the standard settings about the horizontal tool axis A—A, as represented by the series of holes 32 disposed to the sides of a 0° marking, into a selected one of said openings (holes) an index pin is readily insertible. The angle dresser of the invention also provides for non-standard angular settings of the dovetail way member simply by deactivation of the index pin 30, when non-standard angular settings are called for.

From the foregoing detailed description of my invention and drawing figures illustrative of its parts and their relationship, taken with the above brief description of its mode of operation, the advantages of an angle dressing tool according to the herein invention in terms of its simplified, inexpensive constructional features, its speed of set-up, its accuracy coupled with its safety-in-operation features, will become readily apparent. It is to be understood, however, that the invention is not limited to the precise form of angle dresser as illustrated (although such is a preferred form which has been found to be satisfactory in practice) and accordingly that changes may be made therein which fall within the terms and spirit of the appended claims.

I claim:

1. An angle dressing tool for dressing angular surfaces of rotating grinding wheels and the like comprising: a horizontal base plate; a planar-faced upright member mounted on said base plate and extending transversely thereacross; a dovetail way member and a dovetail slide member having complemental ways enabling the slide member to be translated in linear directions along the way of the way member; means mounting said dovetail way member flush against the rear planar face of the upright member and for releasably securing said way member in a selected angular position about a horizontal axis extending through a hole provided in said upright member, said means including a bushing having axial length greater than the thickness dimension of said upright member mounted in said hole, bolt and clamp-washer means for securing said bushing in said hole in an axial position such that its front-end face is flush with the front planar face of said upright member and that its opposite and projects beyond the rear face of said member and terminates in a recess provided for its reception in a planar rear face provided on said way member and which is sized to snugly receive said projecting end, whereby said projecting end provides a short axial-length hub about which the dovetail way member is turnable, said bolt and clamp-washer means including a headed bolt whose threaded shank has length such that its end extends beyond the rear end face of the bushing and threads into an internally threaded opening provided therefor in the recess of said way member; means operable upon release of said way-member securing means for setting the dovetail way member in a selected angular position comprising pin-and-hole means operable from the front planar face of said upright member; means carried by said way member for imparting linear motion in one or the other opposite direction to the dovetail slide member, means affixed to the front face of said dovetail slide member for movement therewith, said last means mounting an upright shaft-form member provided at its upper end with a diamond dressing element.

2. A dressing tool according to claim 1, wherein said clamp-washer has greater diameter than the diameter of the bushing and is normally held tight against the planar-front face of the upright member and the front-end face of said bushing by the head of said bolt.

3. A dressing tool according to claim 1, wherein the upper edge of said upright extends along a semi-circular arc struck from a center point disposed on said horizontal axis, and wherein a vernier scale is secured to said semi-circular edge.

4. A dressing tool according to claim 1, wherein said means for imparting linear motion as aforesaid to the dovetail slide member comprises leadscrew and nut means operating in a longitudinal open-front recess provided in the way of the dovetail way member, means disposed outwardly of one end of said recess for rotating the leadscrew thereby imparting linear motion in one or the other direction to said nut, means affixing the dovetail slide member to the nut for movement therewith.

* * * * *